US006099588A

United States Patent [19]

McDevitt et al.

[11] Patent Number: 6,099,588

[45] Date of Patent: Aug. 8, 2000

[54] METHOD FOR TREATMENT OF WOOL

[75] Inventors: Jason Patrick McDevitt; Xianghong Caroline Shi, both of Wake Forrest, N.C.

[73] Assignee: Novo Nordisk Biochem North America, Inc., Franklinton, N.C.

[21] Appl. No.: 09/256,609

[22] Filed: Feb. 23, 1999

[51] Int. Cl.[7] ..... D06M 11/38; D06M 11/44; D06M 16/00

[52] U.S. Cl. ..... 8/128.1; 8/94.14; 8/127.5; 8/127.51; 435/263

[58] Field of Search ..... 8/401, 94.1 R, 8/94.14, 127.5, 127.51, 128.1; 435/263, 265

[56] References Cited

U.S. PATENT DOCUMENTS

| | | | |
|---|---|---|---|
| 4,726,522 | 2/1988 | Maue | 8/94.19 R |
| 5,525,509 | 6/1996 | Christner et al. | 435/265 |
| 5,529,928 | 6/1996 | Ciampi et al. | 435/263 |
| 5,980,579 | 11/1999 | Yoon | 8/128.1 |

FOREIGN PATENT DOCUMENTS

| | | |
|---|---|---|
| 134267 | 3/1985 | European Pat. Off. . |
| 358386 | 3/1990 | European Pat. Off. . |
| 51-99196 | 9/1976 | Japan . |
| 6-256793 | 9/1994 | Japan . |
| 96/19611 | 6/1996 | WIPO . |
| 98/53131 | 11/1998 | WIPO . |

OTHER PUBLICATIONS

CAPLUS Abstract of Nolte et al's, "Effects of proteolytic enzymes on untreated and shrink–resist–treated wool," J. text Inst., Part 1, 87(1), p. 212–226, 1996, No month available.

CAPLUS Abstract of Levene et al, "Applying proteases to confer improved shrink–resistance to wool," J. Soc. Dyers Color, 112(1), p. 6–10, 1996, No month available.

*Primary Examiner*—Caroline D. Liott
*Attorney, Agent, or Firm*—Steve T. Zelson, Esq.; Reza Green, Esq.

[57] ABSTRACT

The present invention provides a method of treating wool, wool fibers or animal hair an alkali-containing alcohol solution, followed by a proteolytic enzyme in aqueous solution. The described method results in improved shrink-resistance, and may result in improvements in handle, appearance, wettability, reduction of felting tendency, increased whiteness, reduction of pilling, improved softness, improved tensile strength, and improved dyeing characteristics such as dye uptake and dye washfastness.

14 Claims, No Drawings

METHOD FOR TREATMENT OF WOOL

FIELD OF THE INVENTION

The present invention relates to a method of treating wool, wool fibers or animal hair to provide improved properties such as shrink-resistance and handle.

BACKGROUND OF THE INVENTION

Two major problems associated with wool are its tendencies to prickle (itch) and shrink. Improvements in softness and handle of wool can be achieved by addition of various chemical agents such as silicone softeners or by addition of proteolytic enzymes; however, the cost of these improvements may outweigh the moderate benefits achieved. Furthermore, changes in one property of wool can sometimes have an adverse effect on other properties. For example, protease treatments typically have adverse effects on strength and weight of wool material.

The most commonly used method to increase the shrink-resistance of wool is the IWS/CSIRO Chlorine Hercosett process, which involves acid chlorination followed by application of a polymer. This process imparts a high degree of shrink-resistance to wool, but adversely affects the handle of wool, damages wool fibers, and generates environmentally damaging waste.

Methods intended to maximize beneficial effects while minimizing damage generally attempt to confine degradative reactions to the fiber surface, thereby avoiding serious damage throughout the fiber. McPhee, *Text. Research J.,* 1960, 30:358, describes treatment of fibers with potassium permanganate in a saturated salt solution, under which conditions fiber swelling is reduced. Degradative agents in organic solvents have also been used to modify fiber surfaces under non-swelling conditions. Leeder et al., *Proc. 7th Int. Wool Text. Res. Conf., Tokyo,* 1985, Vol. IV, 312, describes methods for treating wool under non-swelling conditions using a range of anhydrous alkalies in alcohol solvents. Such treatments provide wool with improved shrink-resistance and superior dyeing properties.

Various enzymatic methods have been used to treat wool. JP-A 51099196 describes a process to treat wool fabrics with alkaline proteases. WO 98/27264 describes a method for reducing the shrinkage of wool comprising contacting wool with an oxidase or a peroxidase solution under conditions suitable for reacting the enzyme with wool. U.S. Pat. No. 4,533,359 describes a process for descaling animal fiber which comprises surface-oxidizing the animal fiber with an oxidizing agent and subsequently treating the fiber with a proteolytic enzyme in a saturated or nearly saturated aqueous inorganic-salt solution. U.S. Pat. No. 5,529,928 describes a process for obtaining a wool with a soft woolly handle and shrink-resistant properties by using an initial treatment such as, e.g., a chemical oxidative step or treatment with a peroxidase, catalase, or lipase, followed by protease and heat treatments. EP 358386 A2 describes a method to treat wool which comprises a proteolytic treatment and one of or both an oxidative treatment (such as NaOCl) and a polymer treatment. EP 134267 describes a method for treating animal fibers with an oxidizing agent followed by a proteolytic enzyme in a salt-containing composition.

The environmental and performance deficiencies associated with current industrial processes for wool treatment substantiate the need for novel processes that provide further improvements relating to shrink-resistance or softness. Enzymatic methods for treating wool, used alone or in conjunction with an oxidative chemical step, have had minimal commercial success, which can be attributed to their relatively high cost and their tendency to damage wool by causing weight and strength losses. Thus, there is a need in the art for improved methods to treat wool, wool fibers, or animal hair material which impart improvements in softness, shrink-resistance, appearance, whiteness, dye uptake, and resistance to pilling, but cause less fiber damage than known treatments.

SUMMARY OF THE INVENTION

The present invention provides a method of treating keratinous material which comprises treating the material sequentially with: (a) an alkali-containing alcohol solution, and (b) a proteolytic enzyme in an aqueous solution, under conditions that impart at least one improved property to the keratinous material. Keratinous materials include, without limitation, wool, wool fibers, and animal hair. The alkali-containing alcohol solutions are prepared by adding suitable compounds to an alcohol solution such that alkoxide or hydroxide anions are produced in solution. Suitable compounds include, without limitation, sodium hydroxide, potassium hydroxide, potassium butoxide, ammonium hydroxide, and potassium (metal). The alcohol solvent is preferably a $C_2$–$C_{12}$ alcohol, including, without limitation, monohydric alcohols such as ethanol, cyclohexanol, 1-propanol, 1-butanol, 1-pentanol, and di(ethylene glycol) ethyl ether; dihydric alcohols such as ethylene glycol, 1,2-propanediol, 1,3-propanediol, 1,4-butanediol, and di(ethylene glycol), and higher polyhydric alcohols such as glycerol. Any protease or combination of proteases may be used that provides the desired effect, including, without limitation, a serine protease such as a subtilisin.

The improved properties include, without limitation, improved shrink-resistance, improved handle, improved appearance, improved wettability, reduction of felting tendency, increased whiteness, reduction of pilling, improved softness, improved stretch, improved tensile strength, and improved dyeing characteristics such as dye uptake and dye washfastness. It will be understood that an improvement in one of the above-listed properties is ascertained relative to any of: (i) untreated wool; (ii) wool treated only with alkali-containing alcohol solvent (i.e., the first step of the serial combination); or (iii) wool treated only with proteolytic enzymes. Furthermore, the methods of the invention can result in reduced fiber damage, as manifested by a reduction in fabric weight loss and an increase in burst strength, relative to protease treatments alone.

In another aspect, the present invention provides a method of treating keratinous material which comprises contacting the material with an alkali-containing polyol solution, under conditions that result in at least one of the above-identified improved properties. Suitable polyols include, without limitation, dihydric alcohols such as ethylene glycol, 1,2-propanediol, 1,3-propanediol, 1,4-butanediol, and di(ethylene glycol), and higher polyhydric alcohols such as glycerol. This alkali-containing polyol treatment provides a significant safety advantage relative to the use of, e.g., flammable monohydric alcohols. Furthermore, relative to alkali-containing monohydric alcohol solutions, use of alkali-containing polyol solutions allows treatment to be performed safely at higher temperatures, hereby providing potential benefits in properties such as those cited above.

In yet another aspect, the present invention provides keratinous materials that have been treated using the methods of the invention.

DETAILED DESCRIPTION OF THE INVENTION

The present invention provides methods for treatment of keratinous material, such as, e.g., wool, wool fibers, and animal hair, to improve one or more properties of the material, including, without limitation, shrink-resistance, handle, appearance, wettability, felting tendency, whiteness, resistance to pilling, tensile strength, and dyeability. The methods of the invention provide improved shrink-resistance relative to controls. The methods of the invention provide advantages relative to other known methods of imparting shrink-resistance to wool, including one or more of reduced cost, reduced environmental damage, and improved properties of the treated wool such as strength, whiteness, and handle.

The methods comprise treating the keratinous material sequentially with: (a) an alkali-containing alcohol solution, and (b) a protease. Optionally, the material may be rinsed with an aqueous solution between steps (a) and (b). The material may also be contacted with a softening agent before, during, or after step (b). Surprisingly, treatment of keratinous material with an alkali in alcohol solvent appears to partially protect the wool from undesirable effects of subsequent proteolytic treatment (e.g., strength and weight loss), while maintaining receptivity of the keratinous material to beneficial aspects of proteolytic treatment, such as, e.g., increases in shrink-resistance, whiteness, softness, and dye uptake.

In another aspect, the invention also encompasses treating keratinous material with an alkali-containing polyol solution, without a subsequent proteolytic enzyme treatment step.

The keratinous material on which the invention may be practiced encompasses any animal hair product, including, without limitation, wool from sheep, camel, rabbit, goat, llama, and wool known as merino wool, shetland wool, cashmere wool, alpaca wool, mohair, and the like. The wool or animal hair material can be in the form of top, fiber, yarn, or woven or knitted fabric. The methods of the invention can also be carried out on loose flock or on garments made from wool or animal hair material.

The methods of the invention can be practiced either alone or in combination with other treatments such as scouring or dyeing, and treatment can be performed at many different stages of processing, including either before or after dyeing. A range of different chemical additives can be added along with the enzymes, including wetting agents and softeners.

Alkali-Containing Alcohol Treatment

In practicing the present invention, an alkali-containing alcohol solution is prepared using an alcohol that preferably contains between 2–12 carbon atoms, including, without limitation, monohydric alcohols such as ethanol, cyclohexanol, 1-propanol, 1-butanol, cyclohexanol, and di(ethylene glycol) ethyl ether; and polyols such as ethylene glycol, 1,2-propanediol, 1,3-propanediol, 1,2-butanediol, 1,4-butanediol, 1,2-pentanediol, 1,2-hexanediol, di(ethylene glycol), di(propylene glycol), tri(ethylene glycol), tetra (ethylene glycol), 2-methyl-2,4-pentanediol, 2-butene-1,4-diol, cyclohexanedimethanol, and isomers of the aforementioned compounds. Polyols are defined herein as compounds containing more than one hydroxy group.

In a preferred embodiment, the alkali-containing alcohol solution is a polyol. Many polyols have significantly higher boiling points and flash points relative to monohydric alcohols, in particular relative to commodity-type alcohols used as solvents. Thus, polyols can be safer and more practical to use on an industrial scale. Furthermore, the ability to work at higher temperatures may yield improvements in properties of the keratinous materials. It is understood that a polyol solution need not be composed of 100% polyols; water and monohydric alcohols may be present, either as impurities, residual components, or additives. In particularly preferred embodiments, the polyol solution is a solution wherein greater than 80% of the total alcohols on a weight basis are polyols.

In practicing the invention, an alkali-containing alcohol solution is produced by adding one or more different chemicals to an alcohol solvent or a mixture of alcohol solvents. Alkali-containing alcohol solutions contain compounds of the type ROH and $RO^-$, wherein $RO^-$ is anionic, and R can be independently hydrogen, hydrocarbyl, or substituted hydrocarbyl. A "hydrocarbyl" group as used herein refers to a linear, branched, or cyclic group which contains only carbon and hydrogen atoms. A "substituted hydrocarbyl" as used herein refers to a hydrocarbyl substituted with one or more heteroatoms. Typically, the alkali-containing alcohol solution contains between about 0.001M and about 0.5M $RO^-$, preferably, between about 0.01 M and about 0.1M $RO^-$.

A suitable base, such as, e.g., sodium hydroxide, potassium hydroxide, calcium hydroxide, or ammonium hydroxide, may be added directly to an alcohol solvent, such as, e.g., propanol, in order to produce an alkali-containing alcohol solution. Alternatively, the alkali-containing alcohol solution can be produced by addition of alkali or alkaline earth metals to alcohol solutions, such as, e.g., by addition of potassium to tert-butanol.

In practicing the present invention, it will be understood that addition of bases to alcohol solvents can produce rapid equilibration. For example, addition of sodium hydroxide to methanol produces an equilibrium mixture of hydroxide and methoxide anions in solution. The dynamic equilibrium may be affected over the course of the treatment by liberation of compounds from wool, including peptides and lipids. Frequently, compounds released from wool will be acidic, and thereby neutralize some of the alkali in the alcohol solution. Furthermore, addition of suitable compounds to alcohol solutions may not result in their immediate dissolution, and the rate of dissolution may be affected by factors such as temperature and concentration.

In preferred embodiments, the alkali-containing alcohol solutions contain less than about 10% (by weight) water, preferably less than about 2% water. Hydrated keratinous material, such as wool, can also contribute water molecules to any equilibrium mixture used to treat this material.

Typically, the keratinous material is contacted with the alkali-containing alcohol solution for a period between about 1 sec and about 90 minutes, preferably between about 1 min and about 60 minutes; at a temperature between about −15° C. and about 120° C., preferably between about 0° C. and about 110° C., most preferably between about 20° C. and 100° C. The particular conditions that are used are dependent, among other factors, on the particular alcohol or alcohols used as the solvent.

Optionally, the keratinous material that has been treated with an alkali-containing alcohol solution may be rinsed with water prior to protease treatment.

Protease Treatment

In practicing the invention, any proteolytic enzyme may be used that exhibits proteolytic activity at the actual process conditions, including a combination of two or more such enzymes. The proteases may be of microbial origin, i.e., from bacteria, fungi, or yeast; of plant origin, such as, e.g., papain, bromelain, ficin; or of animal origin, such as, e.g., trypsin and chymotrypsin.

Furthermore, any proteolytic enzyme variant can be used in the process of the present invention. As used herein, "variant" refers to an enzyme produced by an organism expressing a gene encoding a proteolytic enzyme that has been obtained by mutation of a naturally occurring proteolytic enzyme gene, the mutation being of either random or site-directed nature, including the generation of the mutated gene through gene shuffling.

In preferred embodiments, the proteolytic enzyme is a serine-protease, a metalloprotease, or an aspartate-protease. A serine protease is an enzyme that contains an essential serine residue at the active site (White, Handler and Smith, 1973 "Principles of Biochemistry," Fifth Edition, McGraw-Hill Book Company, NY, pp. 271–272). Serine proteases are typically inhibited by diisopropylfluorophosphate, but, in contrast to metalloproteases, are resistant to ethylene diamino tetraacetic acid (EDTA) (although they are stabilized at high temperatures by calcium ions). Serine proteases usually exhibit maximum proteolytic activity in the alkaline pH range, whereas the metallo-proteases and the aspartate-proteases usually exhibit maximum proteolytic activity in the neutral and the acidic pH ranges, respectively.

Preferred proteases are the subtilases, a type of serine protease defined by homology (Siezen et al., *Protein Engng.* 4 (1991) 719–737). The amino acid sequences of a number of subtilases have been determined, including at least six subtilases from Bacillus strains, namely, subtilisin 168, subtilisin BPN', subtilisin Carlsberg, subtilisin DY, subtilisin amylosacchariticus, and mesentericopeptidase, one subtilisin from an actinomycetales, thermitase from *Thermoactinomyces vulgaris,* and one fungal subtilisin, proteinase K from *Tritirachium album.* One type of subtilase, the subtilisins, has been further divided into two sub-groups. One subgroup, I-S1, comprises the "classical" subtilisins, such as subtilisin 168, subtilisin BPN', subtilisin Carlsberg (ALCALASE®, Novo Nordisk A/S), and subtilisin DY. The other subgroup, I-S2, is described as highly alkaline subtilisins and comprises enzymes such as subtilisin PB92 (MAXACAL®, Genencor International, Inc.), subtilisin 309 (SAVINASE®, Novo Nordisk A/S), subtilisin 147 (ESPERASE®, Novo Nordisk A/S), and alkaline elastase YaB.

These subtilisins of group I-S2 and variants thereof constitute a preferred class of proteases which are useful in the method of the invention. An example of a useful subtilisin variant is a variant of subtilisin 309 (SAVINASE®) wherein, in position 195, glycine is substituted by phenylalanine (G195F or $^{195}$Gly to $^{195}$Phe).

Conveniently, conventional fermented commercial proteases are useful. Examples of such commercial proteases are Alcalase® (produced by submerged fermentation of a strain of *Bacillus licheniformis*), Esperase® (produced by submerged fermentation of an alkalophilic species of Bacillus), Rennilase® (produced by submerged fermentation of a non-pathogenic strain of *Mucor miehei*), Savinase® (produced by submerged fermentation of a genetically modified strain of Bacillus), e.g., the variants disclosed in the International Patent Application published as WO 92/19729, and Durazym® (a protein-engineered variant of Savinase®). All the mentioned commercial proteases are produced and sold by Novo Nordisk A/S, DK-2880 Bagsvaerd, Denmark. Other preferred serine proteases are proteases from Nocardiopsis, Aspergillus, Rhizopus, *Bacillus alcalophilus, B. cereus, N. natto, B. vulgatus, B. mycoide,* and subtilins from Bacillus, especially proteases from the species Nocardiopsis sp. and *Nocardiopsis dassonvillei* such as those disclosed in the International Patent Application published as WO 88/03947, especially proteases from the species Nocardiopsis sp., NRRL 18262, and *Nocardiopsis dassonvillei,* NRRL 18133. Yet other preferred proteases are the serine proteases from mutants of Bacillus subtilins disclosed in the International Patent Application Nos. PCT/DK89/00002 and PCT/DK97/00500, and in the International Patent Application published as WO 91/00345, and the proteases disclosed in EP 415 296 A2.

Another preferred class of proteases are the metalloproteases of microbial origin. Conveniently, conventional fermented commercial proteases are useful. An example of such a commercial protease is Neutrase® (Zn) (produced by submerged fermentation of a strain of *Bacillus subtilis*), which is produced and sold by Novo Nordisk A/S, DK-2880 Bagsvaerd, Denmark.

Other useful commercial protease enzyme preparations include Bactosol™ WO and Bactosol™ SI, available from Sandoz AG, Basle, Switzerland; Toyozyme™, available from Toyo Boseki Co. Ltd., Japan; and Proteinase K™ (produced by submerged fermentation of a strain of Bacillus sp. KSM-K16), available from Kao Corporation Ltd., Japan.

The amount of proteolytic enzyme used is preferably between about 0.001 g and about 20 g enzyme protein, preferably between about 0.01 g and about 10 g, more preferably between about 0.05 g and about 5 g, per kg keratinous material.

Typically, the material is contacted with the enzyme-containing solution for a period of between about 1 minute and about 150 minutes, at a temperature between about 15° C. and about 90° C., preferably between 35° C. and 75° C. The aqueous solution may comprise a buffer (at acidic, neutral, or alkaline pH), as well as one or more surfactants and/or softeners. It will be understood that pH may change over the course of the reaction. It will further be understood that particular conditions, such as, e.g., enzyme concentration, pH, buffer composition, time, and temperature, may vary, depending on the source of keratinous material, the enzyme, and the nature of the alkali-containing alcohol treatment step. Optimization of these and other variables can be achieved using routine experimentation.

Furthermore, because wool and other animal hair materials are of biological origin, they may vary greatly in chemical composition and morphological structure, depending on the living conditions and health of the animal. Accordingly, the effect(s) obtained by subjecting wool or other animal hair products to the methods of the present invention may vary in accordance with the properties of the starting material.

Softening Agents

Softening agents may be used either during or after enzymatic treatments. Any conventional softener may be used, including, without limitation, cationic softeners, either organic cationic softeners or silicone-based products; anionic softeners; and non-ionic softeners. Non-limiting examples of useful softeners include polyethylene softeners; silicone softeners, such as, e.g., dimethyl polysiloxanes (silicone oils), H-polysiloxanes, silicone elastomers, aminofunctional dimethyl polysiloxanes, aminofunctional silicone elastomers, and epoxyfunctional dimethyl polysiloxanes; and organic cationic softeners, such as, e.g., alkyl quaternary ammonium derivatives.

Improved Properties

The methods of the invention result in improvements in one or more properties of wool and other keratinous materials, including, without limitation, shrink-resistance, handle, appearance, wettability, whiteness, resistance to pilling, tensile strength, and dyeability. In particular, the methods of the invention result in improved shrink-resistance relative to untreated wool. Methods that encompass a series of treatment steps also provide improved shrink-resistance relative to wool that receives less than the total number of treatment steps.

Treatment of wool, wool fibers, or animal hair with an alkali-containing alcohol solution provides improvements in shrink-resistance and pilling-resistance relative to untreated wool. Treatment of wool with an alkali-containing polyol solution provides improvements in shrink-resistance and pilling-resistance relative to untreated wool, and has associated safety advantages compared to treatment of wool with an alkali-containing monohydric alcohol solvent.

Treatment of wool with a proteolytic enzyme treatment after initial treatment with an alkali-containing alcohol solution (optionally also following a rinsing step), provides significant additional benefits in terms of whitening, softening, and shrink-resistance (relative to wool treated only with an alkali-containing alcohol solution, i.e., no proteolytic enzyme step). Relative to wool subjected only to the second step of the treatment (i.e., the protease step, no alkali-containing alcohol step), wool receiving the serial combination treatment yields superior shrink-resistance, and preferably provides reduced damage as manifested by reductions in weight loss and strength loss.

It is surprising that pre-treatment with alkali in alcohol solvent effectively protects the wool from undesirable effects of proteolytic treatment such as strength and weight losses, while maintaining receptivity of the wool to beneficial aspects of proteolytic treatment such as shrink-resistance, whitening, softening, and dye uptake. Without wishing to be bound by theory, it is believed that wool subjected to an initial alkali-containing alcohol solution treatment appears to undergo morphological and/or chemical changes that help protect the fiber from internal damage during proteolytic treatment.

Many different variables can be adjusted in order to achieve different physical property outcomes. For example, the quantity of proteolytic enzyme can be decreased in order to reduce weight loss, but this may also lead to a decrease in shrink-resistance.

The buffer system utilized during proteolytic treatment is a very important variable. Changing the pH, buffer salt, or buffer salt concentration can have dramatic effects on properties such as weight loss and shrink-resistance. It will be understood that these factors can be optimized for particular purposes. For example, according to the method of this invention, and with all other factors identical, treatment of wool with proteolytic enzymes in diethanolamine buffers frequently provides wool with reduced weight loss, but also reduced shrink-resistance, relative to wool treated with proteolytic enzymes in borate buffers at the same pH and ionic strength. It is contemplated that buffer systems may be optimized such that within a given range, a well-chosen buffer can provide improved shrink-resistance and reduced weight loss relative to another buffer system.

Shrink-resistance is determined by measuring the felting shrinkage of fibers, which is the irreversible shrinkage caused by progressive entanglement of the wool fibers induced by washing in an aqueous solution. Felting shrinkage is defined as the reduction in length and/or width and/or area induced by washing, after accounting for initial relaxation shrinkage. Shrinkage can be measured by any conventional procedure, including, without limitation, IWS TM 31 or the following procedure (which is used in the Examples below). Wool samples (24 cm×24 cm) are sewn around the edges and inscribed with a rectangle (18 cm×18 cm). Samples are treated, air-dried, then subjected to five cycles of machine washing and drying (warm wash, high heat of drying) in combination with external ballast such as towels and articles of clothing. The dimensions of the rectangle are measured after five cycles, and the shrinkage is defined as the change in dimensions of the rectangle. For the fabric used herein, the relaxation shrinkage accounts for a loss of area from 324 $cm^2$ down to 264 $cm^2$. All further area loss, referred to as "shrinkage", is ascribed to felting shrinkage. An increase in shrink-resistance implies a reduction in felting, and thus all methods that provide improved shrink-resistance also provide "anti-felting" properties.

"Improved shrink-resistance" is defined as a positive change in shrink-resistance as measured using either IWS TM 31 or the alternate procedure described above. Preferably, the change is statistically significant. It will be understood that the magnitude of this change is dependent upon many variables, including the nature of the keratinous material. For example, the methods of the invention, when practiced upon the fabric used herein (jersey knit wool from TestFabrics, Inc., style TF532), will yield a statistically significant positive change in shrink-resistance.

Handle refers to the sensation of touch or feel of a textile, including softness. Fabric handle is evaluated by panel testing, using a rating of 1–3 (worst to best).

One aspect of appearance is whiteness, which reflects the extent of color on wool. Whiteness can be measured using any conventional method, including the CIE Ganz 82 method on a suitable spectrophotometer such as the Macbeth Color-Eye® 7000.

Pilling resistance is determined by measuring pilling, which is the entangling of fibers into balls (pills) which are of sufficient density to cast a shadow and thus be visible on the surface of a fabric. Pilling can be measured using any conventional method, such as, e.g., using IWS Test Method 196, or American Society for Testing and Materials protocol ASTM D 4970-89, using a Martindale Abrasion and Pilling Tester (James H. Heal & Co, UK). In the latter method, pilling is evaluated visually on a scale of 1 to 5, where 1 signifies severe pilling and 5 signifies no pilling. Pilling is a major component of fabric appearance (along with other properties such as whiteness).

Fabric strength is measured using any conventional method, such as, e.g., according to IWS TM 29 or ASTM protocol D 3786-87, using a Mullen Burst tester (Model C, B.F. Perkins, Chicopee Mass.). Burst strength refers to the pressure applied to a circular specimen in distending it to rupture. Burst strength can be measured on either wet or dry fabric.

Dyeabilty characteristics include dye uptake and dye color fastness to wet alkaline contact (as defined in IWS TM 174). Dye uptake is a measure of the capacity of wool or animal hair material immersed in a dye solution to absorb available dyestuff. This property can be measured by the following test. In a suitable reaction vessel, wool or animal hair material is added to a buffered solution of acid black 172 (300 ml of 0.05 M NaOAc buffer, pH 4.5, plus 7.5 mL of a 1.0% w/w solution of acid black 172 in water). The vessel is incubated in a shaking water bath at 50° C. for 15 minutes with mild agitation. After removal of the material from solution, it is allowed to air-dry, then measured in a suitable spectrophotometer to determine CIELAB values. Dye uptake is determined by the L* reading, and changes in dye uptake are found by determining dL* relative to untreated material.

The following examples are intended as non-limiting illustrations of the present invention.

Methods:

The examples provided below were performed on swatches (24 cm×24 cm, with 18×18 $cm^2$ rectangle inscribed on each, approximately 9 g each) of jersey knit wool (from TestFabrics, style TF532). Samples were routinely subjected to five wash/dry cycles prior to testing of physical properties. Samples were machine washed according to the following conditions:

| | |
|---|---|
| Water Level | small load |
| Load Weight | around 1.4 kg |
| Detergent | 0.5% AATCC standard detergent |
| Temperature | Hot/Cold |
| Wash Speed | Regular (fast/slow) |
| Wash Time | 6 min |
| Rinse | Second rinse |
| Total Time | 45 min |
| Dry Cycle | medium (knit) |

Samples were machine tumble-dried according to the following conditions, using a medium (knit) cycle:

| | |
|---|---|
| Temperature | less than 60° C. |
| Time | 60 minutes |
| Cool Down Time | 10 minutes |
| Total Time | 70 minutes |

In the data tables provided in the examples below, the following abbreviated column headings are used, and all refer to properties tested after five machine wash/dry cycles: Area 5W/D refers to the area of the square marked on the wool after five machine wash/dry cycles. Shrinkage refers to the area of the square relative to the pre-determined "zero felting shrinkage" area of 264 $cm^2$. Weight Loss refers to the change in weight of the equilibrated fabric after treatment and five wash/dry cycles relative to the original weight of the fabric. A positive number for weight loss indicates a loss in weight, while a negative number indicates an apparent gain in weight (generally attributable to greater moisture uptake). Yellowness refers to the extent of yellow color in the fabric, measured according to ASTM standard method E313. Whiteness is measured according to the CIE Ganz 82 method. Dye uptake refers to the color of fabric after testing for dye uptake as described in the detailed description section. Higher numbers for dL* correspond to less dye uptake. Burst Strength refers to the wet burst strength of the fabric, and is an average of at least five measurements. A data entry of n/a indicates that a measurement was not obtained.

EXAMPLE 1

Method: Groups of five wool swatches were placed in Launder-O-meter beakers containing either organic solvent (180 mL 1-butanol, 320 mL 1-propanol) or a water blank (500 mL water), along with 0.5 g NaOH (pre-dissolved), and treated in the Launder-O-Meter, with mild agitation, for 30 minutes at 29° C. Swatches were removed from the vessels and rinsed, then subjected to a proteolytic treatment.

Groups of two swatches were added to Launder-O-Meter vessels containing 500 mL buffer (Sodium borate $H_2SO_4$ buffer, 0.01 M, pH 8.2). A protease solution, either 0.2 mL of ESPERASE® 8.0 L (commercial preparation having an activity, in Kilo Novo Protease Units, of 8.0 KNPU(E)/g, wherein the proteolytic activity is determined relative to the enzyme standard using an automated kinetic assay described in Novo Nordisk publication AF-220) or 0.2 mL of SAVINASE® 16.0 L (16.0 KNPU(S)/g) was then added to the vessels (control samples were placed in 500 mL water, to which no protease solution was added). Samples were agitated in the Launder-O-Meter for 40 minutes at 44° C., after which the temperature was raised to 80° C. over ten minutes, then held at 80° C. for ten minutes to deactivate the enzyme. The samples were removed from solution, rinsed, dried in an atmosphere of constant temperature and humidity, weighed and measured, after which they were subjected to five cycles of machine washing and drying.

Results: The swatches were evaluated for weight, shrinkage, yellowness, and whiteness. The results are shown in Table 1 below:

TABLE 1

| Sample | Pre-treatment Solvent | Enz. Treatment Protease | Weight Loss (%) | Area 5W/D ($cm^2$) | Shrinkage (%) | Yellowness (ASTM) | Whiteness (CIE Ganz) |
|---|---|---|---|---|---|---|---|
| 1 | aqeuous | none | −0.2 | 196.5 | 25.6 | 25.4 | −20.3 |
| 2 | aqueous | none | −0.2 | 186.3 | 29.4 | 25.3 | −20.1 |
| 3 | aqueous | Savinase | 14.0 | 247.5 | 6.3 | 21.0 | −0.4 |
| 4 | aqueous | Savinase | 13.7 | 249.4 | 5.6 | 21.3 | −2.0 |
| 5 | aqueous | Esperase | 15.3 | 250.4 | 5.2 | 20.7 | 0.8 |
| 6 | aqueous | Esperase | 15.1 | 250.9 | 5.0 | 20.5 | 1.4 |
| 7 | solvent | none | −0.5 | 249.1 | 5.6 | 25.1 | −16.5 |
| 8 | solvent | none | −0.6 | 248.0 | 6.1 | 25.3 | −17.8 |
| 9 | solvent | Savinase | 5.3 | 254.2 | 3.7 | 22.4 | −5.2 |
| 10 | solvent | Savinase | 5.3 | 251.5 | 4.7 | 22.5 | −6.0 |
| 11 | solvent | Esperase | 5.5 | 259.5 | 1.7 | 22.8 | −6.6 |
| 12 | solvent | Esperase | 4.9 | 263.4 | 0.2 | 22.5 | −5.9 |

These results demonstrate that, while alkali-containing alcohol solution treatments alone provide significant improvements in shrink-resistance relative to control samples, and protease treatments (after an initial alkaline aqueous wash) also provide significant shrink-resistance and whitening relative to control samples (though at the expense of weight loss, and, presumably, strength loss as well), the methods of the invention, i.e., alkali-containing alcohol treatment followed by proteolytic treatment, provide additional benefits in whiteness and shrink-resistance relative to untreated wool or wool treated only with the initial alkali-containing alcohol treatment, and provide improvements in shrink-resistance and strength/weight loss relative to wool treated sequentially with aqueous base and then proteolytic enzymes. Most importantly, the alkali-containing alcohol solution treatment protects the wool from excessive, detrimental weight losses caused by ensuing proteolytic treatments (compare the weight losses in samples 9–12 with those in samples 3–6), but permits the desirable aspects of proteolytic treatments, such as reducing itch, reducing yellowness, and reducing shrinkage of wool.

EXAMPLE 2

Method: Groups of four wool swatches were placed in Launder-O-meter beakers containing 500 mL of an alcohol (methanol, ethanol, 1-propanol, 1-butanol, or tert-butanol) or water, along with 1.0 g NaOH (pre-dissolved), and treated in the Launder-O-Meter, with mild agitation, for 20 minutes at 32° C. Swatches were removed from the vessels and rinsed, then subjected to proteolytic treatment.

Groups of two swatches were added to Launder-O-Meter vessels containing 500 mL buffer (either sodium borate/$H_2SO_4$ buffer, 0.01 M, pH 8.2; or diethanolamine/$H_2SO_4$ buffer, 0.01 M, pH 8.6). A protease solution (0.2 mL of ESPERASE® 8.0) was then added to the vessels. Samples were agitated in the Launder-O-Meter for 40 minutes at 44° C., after which the temperature was raised to 80° C. over ten minutes, then held at 80° C. for ten minutes to deactivate the enzyme. The samples were removed from solution, rinsed, dried in an atmosphere of constant temperature and humidity, weighed and measured, then subjected to five cycles of machine washing and drying.

Results: The swatches were evaluated for weight, shrinkage, yellowness, whiteness, and dye uptake. The results are shown in Table 2 below:

TABLE 2

| Sample | Pre-treat Solvent | Enzyme Treatment Buffer | Weight Loss (%) | Area 5w/d ($cm^2$) | Shrinkage (%) | Yellowness (ASTM E313) | Whiteness (CIE Ganz) | Dye Uptake (dL*) |
|---|---|---|---|---|---|---|---|---|
| 1 | water | borate | 33.8 | 256.0 | 3.0 | 16.8 | 16.2 | 44.0 |
| 2 | water | borate | 34.5 | 257.6 | 2.4 | 16.7 | 16.3 | n/a |
| 3 | water | diethanolamine | 23.0 | 246.0 | 6.8 | 18.5 | 9.1 | 43.4 |
| 4 | water | diethanolamine | 22.9 | 253.1 | 4.1 | 17.5 | 13.3 | n/a |
| 5 | methanol | borate | 16.7 | 255.8 | 3.1 | 18.5 | 9.0 | 45.1 |
| 6 | methanol | borate | 18.3 | 261.1 | 1.1 | 18.1 | 10.8 | n/a |
| 7 | methanol | diethanolamine | 8.5 | 256.4 | 2.9 | 20.0 | 3.0 | 47.3 |
| 8 | methanol | diethanolamine | 8.6 | 253.6 | 3.9 | 20.3 | 1.4 | n/a |
| 9 | n-propanol | borate | 7.5 | 260.1 | 1.5 | 20.6 | 0.9 | 48.3 |
| 10 | n-propanol | borate | 8.1 | 259.1 | 1.9 | 19.6 | 4.1 | n/a |
| 11 | n-propanol | diethanolamine | 3.2 | 259.1 | 1.9 | 20.9 | −1.2 | 52.1 |
| 12 | n-propanol | diethanolamine | 2.8 | 256.5 | 2.8 | 20.7 | −1.3 | n/a |
| 13 | 1-butanol | borate | 9.3 | 262.4 | 0.6 | 19.7 | 4.3 | 47.8 |
| 14 | 1-butanol | borate | 9.4 | 261.3 | 1.0 | 19.7 | 4.6 | n/a |
| 15 | 1-butanol | diethanolamine | 3.5 | 255.3 | 3.3 | 20.4 | 0.4 | 50.9 |
| 16 | 1-butanol | diethanolamine | 3.6 | 255.3 | 3.3 | 20.5 | 0.3 | n/a |
| 17 | ethanol | borate | 7.3 | 258.5 | 2.1 | 20.0 | 2.9 | 48.6 |
| 18 | ethanol | borate | 7.2 | 257.4 | 2.5 | 19.7 | 4.4 | n/a |
| 19 | ethanol | diethanolamine | 3.2 | 256.9 | 2.7 | 21.3 | −2.7 | 51.5 |
| 20 | ethanol | diethanolamine | 3.1 | 254.3 | 3.7 | 20.5 | 0.2 | n/a |
| 21 | t-butanol | borate | 8.0 | 258.0 | 2.3 | 21.0 | −0.8 | 45.3 |
| 22 | t-butanol | borate | 7.6 | 257.4 | 2.5 | 20.2 | 2.7 | n/a |
| 23 | t-butanol | diethanolamine | 3.1 | 255.9 | 3.1 | 20.8 | −0.6 | 55.5 |
| 24 | t-butanol | diethanolamine | 3.1 | 256.4 | 2.9 | 21.6 | −3.8 | n/a |

These results demonstrate that proteolytic treatments following aqueous sodium hydroxide treatments (samples 1–4) caused far more damage to the wool fabric than did comparable protease treatments after initial treatments with sodium hydroxide in an alcohol solution. This damage was manifested in high weight losses. Samples 1–4 suffered more damage, but did not exhibit corresponding improvements in shrink-resistance, relative to samples 5–24 (although whiteness was increased significantly).

These data also indicate that the linkage of weight loss and shrink-resistance can be circumvented by judicious choice of buffer during protease treatments. Samples treated in diethanolamine buffer showed substantially lower weight losses with comparable levels of shrink-resistance relative to samples treated in borate buffer. Other buffers containing an ethanolamine functionality, including biological buffers such as Tris, also share this protective ability. Frequently, however, other non-ethanolamine-type buffers, including borate-based buffers, provide for more efficient use of proteolytic enzymes.

Finally, these data indicate that choice of solvent is also important. Alkali-containing methanol treatments were less effective than treatments in higher alcohols in protecting wool from subsequent proteolytic damage (compare samples 5–8 with samples 9–24).

EXAMPLE 3

Method: Groups of four wool swatches were placed in Launder-O-meter beakers containing either 500 mL of 1-butanol, or a solution containing 1.0 g sodium hydroxide dissolved in 1-butanol. Samples were treated in the Launder-O-Meter, with mild agitation, for 30 minutes at 25° C. Swatches were removed from the vessels and rinsed, then subjected to proteolytic treatment.

Groups of two swatches were added to Launder-O-Meter vessels containing 500 mL aqeuous solution (either sodium borate/$H_2SO_4$ buffer, 0.01 M, pH 8.2; diethanolamine/$H_2SO_4$ buffer, 0.01 M, pH 8.6; or 2 mM sodium hydroxide). Various quantities of a solution of ESPERASE® 8.0 L were then added to the vessels, either 0.2 mL, 0.1 mL, 0.02 mL, or 0 mL (blank) per vessel. Samples were agitated in the Launder-O-Meter for 40 minutes at 44° C., after which the temperature was raised to 80° C. over ten minutes, then held at 80° C. for ten minutes to deactivate the enzyme. The samples were removed from solution, rinsed, dried in an atmosphere of constant temperature and humidity, weighed and measured, then subjected to five cycles of machine washing and drying.

Results: The swatches were evaluated for weight, shrinkage, yellowness, and whiteness. The results are shown in Table 3 below:

TABLE 3

| Sample | Solvent | Esperase quantity (mL/vessel) | Enzyme Treatment Buffer | Weight Loss (%) | Area 5w/d ($cm^2$) | Shrinkage (%) | Yellowness (ASTM E313) | Whiteness (CIE Ganz) |
|---|---|---|---|---|---|---|---|---|
| 1 | butanol | 0 | borate | −0.1 | 192.9 | 26.9 | 22.78 | −12.95 |
| 2 | butanol | 0 | borate | 0.1 | 183.6 | 30.5 | 22.70 | −12.09 |
| 3 | butanol | 0.2 | diethanolamine | 2.2 | 220.0 | 16.7 | 21.35 | −5.27 |
| 4 | butanol | 0.2 | diethanolamine | 2.2 | 212.9 | 19.4 | 21.14 | −4.24 |
| 5 | butanol | 0.02 | borate | 1.2 | 212.8 | 19.4 | 22.42 | −9.21 |
| 6 | butanol | 0.02 | borate | 1.2 | 212.1 | 19.7 | 22.05 | −8.47 |
| 7 | butanol | 0.1 | 2 mM NaOH | 1.9 | 223.0 | 15.5 | 22.27 | −8.35 |
| 8 | butanol | 0.1 | 2 mM NaOH | 1.5 | 224.6 | 14.9 | 21.35 | −4.68 |
| 9 | butanol/NaOH | 0 | borate | 0.2 | 243.3 | 7.8 | 23.83 | −15.93 |
| 10 | butanol/NaOH | 0 | borate | 0.0 | 240.7 | 8.8 | 23.20 | −13.18 |
| 11 | butanol/NaOH | 0.2 | diethanolamine | 3.4 | 256.9 | 2.7 | 21.96 | −7.22 |
| 12 | butanol/NaOH | 0.2 | diethanolamine | 3.4 | 253.3 | 4.1 | 21.60 | −5.66 |
| 13 | butanol/NaOH | 0.02 | borate | −0.2 | 252.8 | 4.3 | 21.95 | −7.70 |
| 14 | butanol/NaOH | 0.02 | borate | −0.2 | 253.8 | 3.9 | 21.98 | −7.90 |
| 15 | butanol/NaOH | 0.1 | 2 mM NaOH | −0.2 | 251.6 | 4.7 | 21.70 | −5.87 |
| 16 | butanol/NaOH | 0.1 | 2 mM NaOH | −0.2 | 254.3 | 3.7 | 21.70 | −6.55 |

These data indicate that butanol treatments, in the absence of added alkali, are not nearly as effective for imparting shrink-resistance to wool as alkali-containing butanol treatments.

Results: The swatches were evaluated for weight, shrinkage, yellowness, and whiteness. The results are shown in Table 4 below:

TABLE 4

| Sample | Solvent | Esperase quantity (mL/vessel) | Enzyme Treatment Buffer | Weight Loss (%) | Area 5w/d ($cm^2$) | Shrinkage (%) | Yellowness (ASTM E313) | Whiteness (CIE Ganz) |
|---|---|---|---|---|---|---|---|---|
| 1 | glycol | 0.2 | diethanolamine | 1.4 | 238.6 | 9.6 | 23.75 | −12.93 |
| 2 | glycol | 0.2 | diethanolamine | 1.1 | 241.3 | 8.6 | 23.65 | −12.11 |
| 3 | glycol/NaOH | 0.2 | diethanolamine | 1.4 | 247.7 | 6.2 | 23.04 | −9.61 |
| 4 | glycol/NaOH | 0.2 | diethanolamine | 1.5 | 245.5 | 7.0 | 22.93 | −9.59 |
| 5 | glycol/NaOH | 0.04 | borate | 0.5 | 240.2 | 9.0 | 23.62 | −12.80 |
| 6 | glycol/NaOH | 0.04 | borate | 0.5 | 244.2 | 7.5 | 23.83 | −13.54 |
| 7 | glycol/NaOH | 0.1 | borate | 2.4 | 250.6 | 5.1 | 23.26 | −11.27 |
| 8 | glycol/NaOH | 0.1 | borate | 2.7 | 252.8 | 4.2 | 23.09 | −10.46 |
| 9 | glycol/NaOH | 0 | water | −0.7 | 206.7 | 21.7 | 23.96 | −14.65 |
| 10 | glycol/NaOH | 0 | water | −0.7 | 214.9 | 18.6 | 24.16 | −16.21 |

EXAMPLE 4

Method: Groups of four wool swatches were placed in Launder-O-Meter beakers containing 500 mL of 1,2-propanediol (propylene glycol) and 1.0 g sodium hydroxide. A single group of two swatches was placed in a Launder-O-Meter beaker containing 250 mL 1,2-propanediol (no added hydroxide). Samples were treated in the Launder-O-Meter, with mild agitation, for 30 minutes at 25° C. Swatches were removed from the vessels and rinsed, then subjected to proteolytic treatment.

Groups of two swatches were added to Launder-O-Meter vessels containing 500 mL aqeuous solution (either sodium borate/$H_2SO_4$ buffer, 0.01 M, pH 8.2; diethanolamine/$H_2SO_4$ buffer, 0.01 M, pH 8.6; or a water blank). Various quantities of a solution of ESPERASE® 8.0 L were then added to the vessels, either 0.2 mL, 0.1 mL, or 0.04 mL, or 0 mL (blank) per vessel. Samples were agitated in the Launder-O-Meter for 40 minutes at 44° C., after which the temperature was raised to 80° C. over ten minutes, then held at 80° C. for ten minutes to deactivate the enzyme. The samples were removed from solution, rinsed, dried in an atmosphere of constant temperature and humidity, weighed and measured, then subjected to five cycles of machine washing and drying.

These data indicate that combining the propylene glycol/NaOH pre-treatment with a subsequent protease treatment conferred good shrink-resistance with low weight loss.

EXAMPLE 5

Method: Groups of two wool swatches were placed in Launder-O-meter beakers containing either 500 mL of 1-butanol and 0.5 g sodium hydroxide, or 400 mL 1-butanol, 100 mL water, and 0.5 g sodium hydroxide, or a buffer (sodium borate/$H_2SO_4$ buffer, 0.01 M, pH 8.2) blank containing no sodium hydroxide. Samples were treated in the Launder-O-Meter, with mild agitation, for 30 minutes at 25° C. Swatches were removed from the vessels and rinsed, dried in an atmosphere of constant temperature and humidity, weighed and measured, then subjected to five cycles of machine washing and drying.

Results: The swatches were evaluated for weight, shrinkage, and tensile strength. The results are shown in Table 5 below:

TABLE 5

| Sample | Solvent Treatment | Weight Loss (%) | Area 5w/d ($cm^2$) | Shrinkage (%) | Burst Strength (lb/sq. in.) |
|---|---|---|---|---|---|
| 1 | buffer blank | −1.3 | 185.8 | 29.6 | 33.8 |
| 2 | buffer blank | −1.1 | 185.9 | 29.6 | n/a |
| 3 | butanol/NaOH | −1.1 | 244.9 | 7.2 | 36.5 |
| 4 | butanol/NaOH | −0.8 | 240.2 | 9.0 | n/a |
| 5 | butanol/water/NaOH | −0.2 | 223.5 | 15.3 | 29.6 |
| 6 | butanol/water/NaOH | −0.3 | 222.9 | 15.6 | n/a |

These results indicate the desirability of avoiding too much water in the solvent treatment step.

EXAMPLE 6

Method: A group of four wool swatches was placed in a Launder-O-Meter beaker containing 310 mL glycol solution (120 mL of 1,4-butanediol, 190 mL of ethylene glycol) and 1.0 g potassium hydroxide. A second group of four wool swatches was placed in a Launder-O-Meter beaker containing 400 mL water and 1.0 g potassium hydroxide. Samples were treated in the Launder-O-Meter, with mild agitation, for 30 minutes at 49° C. Swatches were removed from the vessels and rinsed, then subjected to proteolytic treatment.

Groups of two swatches were added to Launder-O-Meter vessels containing 500 mL aqeuous solution (sodium borate/$H_2SO_4$ buffer, 0.01 M, pH 8.2). Half of the samples were treated with a solution of ESPERASE® 8.0 L (0.15 mL), while the other half received no proteolytic enzyme treatment. Samples were agitated in the Launder-O-Meter for 40 minutes at 44° C., after which the temperature was raised to 80° C. over ten minutes, then held at 80° C. for ten minutes to deactivate the enzyme. The samples were removed from solution, rinsed, dried in an atmosphere of constant temperature and humidity, weighed and measured, then subjected to five cycles of machine washing and drying.

Results: The swatches were evaluated for weight, shrinkage, and tensile strength. The results are shown in Table 6 below:

TABLE 6

| Sample | Solvent | Esperase quantity (mL/vessel) | Weight Loss (%) | Area 5w/d ($cm^2$) | Shrinkage (%) | Yellowness (ASTM E313) | Whiteness (CIE Ganz) |
|---|---|---|---|---|---|---|---|
| 1 | glycol/KOH | 0.15 | 11.3 | 259.4 | 1.7 | 21.56 | −2.77 |
| 2 | glycol/KOH | 0.15 | 11.4 | 263.5 | 0.2 | 21.77 | −3.74 |
| 3 | glycol/KOH | 0 | −0.9 | 242.1 | 8.3 | 25.37 | −19.70 |
| 4 | glycol/KOH | 0 | −1.0 | 241.7 | 8.4 | 25.54 | −20.20 |
| 5 | water/KOH | 0.15 | 32.9 | 255.4 | 3.3 | 21.63 | −3.86 |
| 6 | water/KOH | 0.15 | 30.2 | 257.6 | 2.4 | 21.50 | −3.33 |
| 7 | water/KOH | 0 | −0.3 | 194.9 | 26.2 | 27.19 | −27.81 |
| 8 | water/KOH | 0 | −0.3 | 197.8 | 25.1 | 27.01 | −28.14 |

These results are indicative of the benefits offered by treatment of wool with an alkali-containing polyol solution. Untreated wool shrinks about 25% when subjected to the conditions of the experiment (as determined by a composite average over many experiments), whereas wool treated with potassium hydroxide in a glycol solution had a shrinkage of less than 10% after five machine wash/dry cycles. After initial treatment of wool with the alkali-containing polyol solution, further treatment with proteolytic enzymes (see samples 1 and 2) provides additional improvements in shrink-resistance and other properties such as whiteness, softness, and dyeability.

All patents, patent applications, and literature references referred to herein are hereby incorporated by reference in their entirety.

Many variations of the present invention will suggest themselves to those skilled in the art in light of the above detailed description. Such obvious variations are within the full intended scope of the appended claims.

What is claimed is:

1. A method for treating a keratinous material, which comprises: contacting the keratinous material sequentially with: (a) an alkali-containing alcohol solution and (b) a protease-containing aqueous solution, wherein said alkali-containing alcohol solution is produced by adding to an alcohol solution an alkali selected from the group consisting of sodium hydroxide, potassium hydroxide, calcium hydroxide, and ammonium hydroxide and wherein said treated material exhibits improved shrink-resistance relative to an untreated material or relative to a material subjected to either (a) or (b).

2. A method as defined in claim 1, wherein said alkali-containing alcohol solution comprises an alcohol selected from the group consisting of ethanol, cyclohexanol, 1-propanol, 2-propanol, 1-butanol, 2-butanol, 2-methyl-2-propanol, 1-pentanol, di(ethylene glycol)ethyl ether, 2-ethoxyethanol, 2-propoxyethanol, 2-butoxyethanol, 3-ethoxy-1-propanol, propylene glycol propyl ether, and combinations of any of the foregoing.

3. A method as defined in claim 1, wherein said alkali-containing alcohol solution is a polyol solution.

4. A method as defined in claim 1, wherein said keratinous material is selected from the group consisting of wool, wool fiber, and animal hair.

5. A method as defined in claim 1, wherein said alkali-containing alcohol solution comprises less than about 10% water.

6. A method as defined in claim 5, wherein said alkali-containing alcohol solution comprises less than about 2% water.

7. A method as defined in claim 1, further comprising, after step (a) and prior to step (b), rinsing the material with an aqueous solution.

8. A method as defined in claim 1, wherein said protease is of bacterial, fungal, plant, or animal origin.

9. A method as defined in claim 8, wherein said protease is selected from the group consisting of papain, bromelain, ficin, and trypsin.

10. A method as defined in claim 8, wherein the protease is a serine protease.

11. A method as defined in claim 10, wherein the serine protease is a subtilisin derived from Bacillus or Tritirachium.

12. A method as defined in claim 1, wherein the material is contacted with between about 0.001 g to about 10 g protease per kg material.

13. A method as defined in claim 1, further comprising, after step (a) and either simultaneously with or after step (b), contacting the material with a softening agent.

14. A keratinous material treated by a method as defined in claim 1.

* * * * *